US008113533B2

(12) United States Patent
Largueze et al.

(10) Patent No.: US 8,113,533 B2
(45) Date of Patent: Feb. 14, 2012

(54) SNOWBOARD AND ASSEMBLY FOR THE PRACTICE OF SNOWBOARDING

(75) Inventors: Philippe Largueze, Grenoble (FR); Marie Lorene Barth, Moirans (FR); Nicolas Puget, Annecy le Vieux (FR)

(73) Assignee: Skis Rossignol, Moirans (FR)

( * ) Notice: Subject to any disclaimer, the term of this patent is extended or adjusted under 35 U.S.C. 154(b) by 447 days.

(21) Appl. No.: 12/255,841

(22) Filed: Oct. 22, 2008

(65) Prior Publication Data

US 2009/0134590 A1 May 28, 2009

(30) Foreign Application Priority Data

Nov. 23, 2007 (FR) ..... 07 59277

(51) Int. Cl.
*A63C 5/04* (2006.01)
*A63C 5/00* (2006.01)
*B62B 19/00* (2006.01)

(52) U.S. Cl. ..... 280/609; 280/601; 280/14.21

(58) Field of Classification Search ..... 280/14.21, 280/809, 815, 816, 610, 608, 609, 601; 40/584, 40/586, 607.13, 607.15, 611.13, 611.08, 40/618, 620, 622

See application file for complete search history.

(56) References Cited

U.S. PATENT DOCUMENTS

| | | | | |
|---|---|---|---|---|
| 3,567,237 | A * | 3/1971 | Miller, III | 280/610 |
| 5,888,332 | A * | 3/1999 | Ciriello | 156/249 |
| 6,059,308 | A * | 5/2000 | Baudin et al. | 280/610 |
| 6,478,917 | B1 * | 11/2002 | Magoni et al. | 156/245 |
| 7,147,399 | B2 * | 12/2006 | Viscount et al. | 403/349 |
| 7,261,791 | B2 * | 8/2007 | Chaumat et al. | 156/245 |
| 7,487,991 | B2 * | 2/2009 | Degasperi et al. | 280/607 |
| 2006/0186618 | A1 * | 8/2006 | Bregeon et al. | 280/14.21 |

FOREIGN PATENT DOCUMENTS

| | | | |
|---|---|---|---|
| EP | 0 688 585 | A1 | 12/1995 |
| FR | 1 528 773 | A1 | 6/1968 |
| FR | 2 165 278 | A1 | 8/1973 |
| FR | 2 685 215 | A1 | 6/1993 |

* cited by examiner

*Primary Examiner* — J. Allen Shriver, II
*Assistant Examiner* — James M Dolak
(74) *Attorney, Agent, or Firm* — Burr & Brown

(57) ABSTRACT

A board for gliding on snow includes a bottom at least partly defined by a base, a top and sides which connect the bottom and top to each other. Part of the top and the sides are part of a visible surface of the board in use. The board also includes a first part of means for reversibly mounting at least one removable decorative mask on said visible surface.

17 Claims, 3 Drawing Sheets

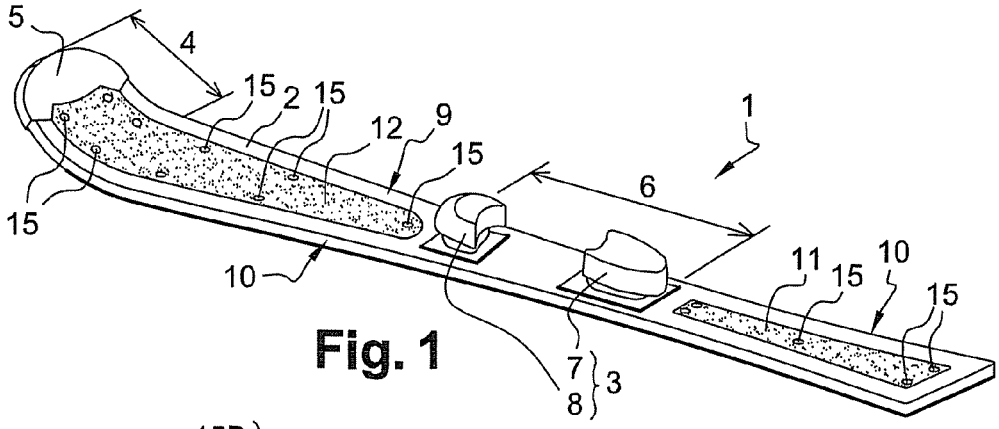
Fig. 1
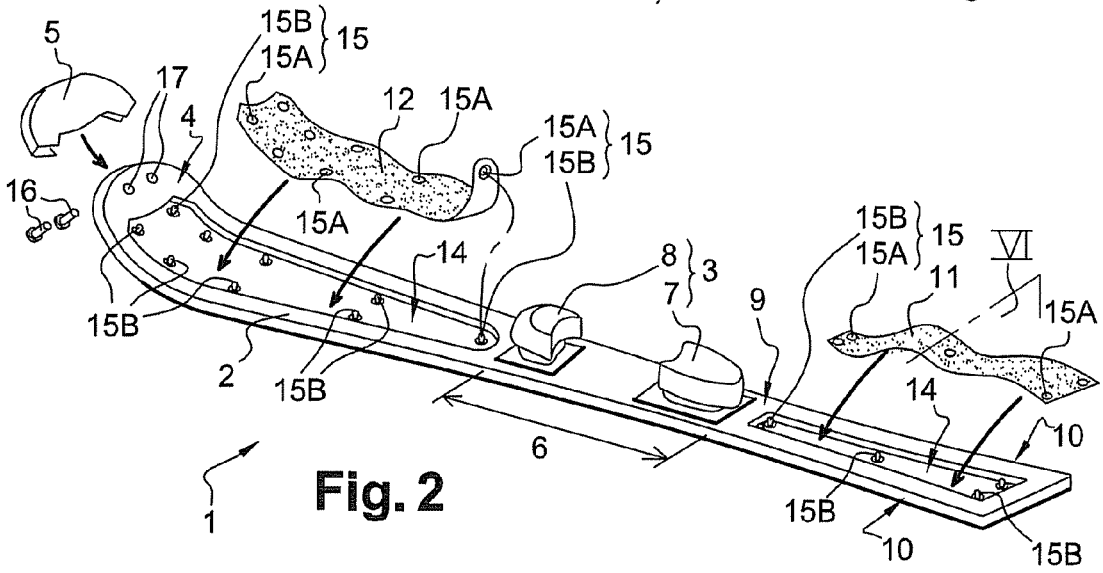
Fig. 2
Fig. 3A
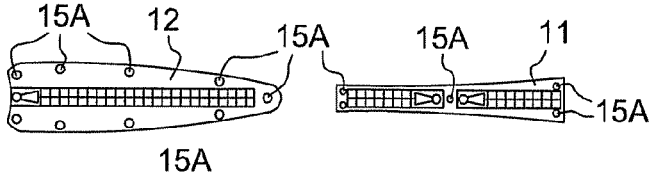
Fig. 3B
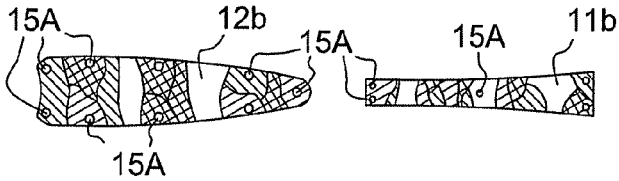
Fig. 3C
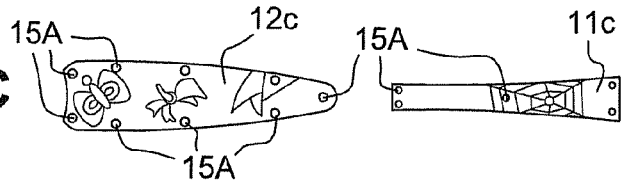

SNOWBOARD AND ASSEMBLY FOR THE PRACTICE OF SNOWBOARDING

FIELD OF THE INVENTION

The present invention relates to the field of snow sports, such as downhill skiing, crosscountry skiing or snowboarding. More precisely, it relates to a board for gliding on snow, and to an assembly adapted for the practice of such a sport and comprising this board.

Snow sports are part of skiing sports in a natural environment, with which a spirit of freedom is often associated, and of which many enthusiasts like to be able to select the equipment expressing their personality. This is why one of the major selection criteria in the purchase of a set of skis or a snowboard is the aesthetics and the style of this ski or this snowboard.

BACKGROUND OF THE INVENTION

The possession of a ski or snowboard having a style and an aesthetics corresponding to one's own taste is a need that manufacturers have been taking into account for several years. To meet this need adequately, marketing services are enlisted today, with the task of accurately grasping the market trends, particularly in terms of style and fashion. For the same purpose, it is common for several ranges of skis or snowboards to be proposed at the same time by the same manufacturer, these ranges being distinguished from one another by their respective aesthetics.

The services of marketing specialists and/or the proposal of several ranges of different styles represent solutions that are costly, without necessarily yielding satisfactory results.

It is also known how to improve the visual appearance of a used board for gliding on snow by masking the wear on its top by an adhesive tape, as proposed by each of the documents FR-2 165 278 and U.S. Pat. No. 3,567,237. Obviously, decorative motifs and/or inscriptions can be associated with such an adhesive tape. Today, however, the top surface of such boards are made from tougher materials than those used at the time when it was proposed to perform renovations by the application of adhesive tapes. These materials are now so rugged that the problem of premature wear of the top of a board for gliding on snow is a secondary factor today. Furthermore, an adhesive tape added on is unsuitable for the requirements of current consumers in terms of finish.

Moreover, any board for gliding on snow is intended to be equipped with a binding for connecting a boot. This binding is generally immobilized on the board by means of screws, each of which is screwed into the threaded hole of an insert present in the board.

SUMMARY OF THE INVENTION

It is at least one object of the invention to offer novel possibilities in terms of matching the aesthetics of a board for gliding on snow to the individual choices of users.

According to the invention, this purpose is achieved by a board for gliding on snow, comprising a bottom at least partly defined by a base, a top and sides which connect the bottom and top to each other, part of the top and the sides being part of a visible surface of the board in use. This board is characterized in that it comprises a first part of means for reversibly mounting at least one removable decorative mask on said visible surface.

The mounting of the decorative mask(s) is reversible in that, after an initial mounting, the reversible mounting means employed for this purpose allow subsequent removal of the mask(s) and can be used again for a remounting of this same mask(s) on the board. In other words, the reversible mounting means are not damaged by a removal of the mask(s) and remain operational after such a removal.

Advantageously, the visible surface of the board bounds a hollow recess for accommodating the decorative mask. The decorative mask placed in this hollow recess projects only slightly, if at all, from the board, thereby protecting it while participating in its harmonious integration with the board.

According to one possible embodiment, the first part of said reversible mounting means may advantageously comprise at least two slots for inserting, with or without snap-in, nesting tabs of the decorative mask. When this is the case, each of the two slots for inserting the nesting tabs may terminate in one of the two opposite sides of the hollow recess.

According to another possible embodiment, the hollow recess may advantageously comprise a peripheral edge in which said first part of the reversible mounting means comprises a groove for accommodating and retaining one edge of the decorative mask, said groove extending at least on most of the length of said peripheral edge.

According to a further possible embodiment, the reversible mounting means may advantageously comprise a plurality of snap fasteners in two matching elements which are joinable to each other and of which one is fixed to the board. For at least part of them, the snap fasteners may advantageously be disposed in succession along a closed contour.

According to another possible embodiment, the reversible mounting means may advantageously comprise a velcro means of which part is fixed to the board.

According to a further possible embodiment, the first and a second part of the reversible mounting means may advantageously comprise two elements which are mutually attracted by ferromagnetism and whereof one is fixed to the board.

Advantageously, said removable decorative mask comprises a second part of the reversible mounting means. When the board carries said removable decorative mask, the first and second part of the reversible mounting means are then joined and/or connected to each other matchingly.

Advantageously, the hollow recess and the decorative mask have roughly matching peripheral contours.

According to a possible and advantageous embodiment, the decorative mask may comprise a cloth provided with said second part of the reversible mounting means.

According to another possible and advantageous embodiment, the decorative mask may comprise a window provided with said second part of the reversible mounting means, and also a strip which carries a décor visible through the window and which is held between said visible surface of the board and said window.

Advantageously, the decorative mask may comprise a slat provided with said second part of the reversible mounting means. When this is the case, the slat may advantageously be elastically flexible, said second part of the reversible mounting means comprising two nesting tabs carried by and extending beyond said slat and which are insertable into said slots via an elastic bending of this the slat.

Furthermore, the second part of the reversible mounting means may advantageously comprise two tabs carried by said slat, which are insertable into said slots and which are provided with means for nesting in these slots.

Once mounted, the decorative mask may be placed on a protective tip of one end of the board.

The invention also relates to an assembly for the practice of gliding on snow. This assembly is characterized in that it comprises a board as described above, and a set of a plurality of interchangeable decorative masks, each of which comprises a second part of the reversible mounting means, the first and second part of the reversible mounting means being matchingly joinable (i.e., connected) to each other.

The invention further relates to an assembly for the practice of gliding on snow. This assembly comprises a board as described above, provided with at least one binding for connecting a boot and ready to use, and also at least a removable decorative mask which has a second part of the reversible mounting means, in order to be carried by the board, the first and second part of the reversible mounting means being matchingly joinable to each other. Insofar as it is separate from the board, the decorative mask does not constitute a functional element of the board, which is complete without it and which can be used with or without the decorative mask.

BRIEF DESCRIPTION OF THE FIGURES

The invention will be better understood from a reading of the description that follows, provided exclusively as an example and with reference to the appended drawings, in which:

FIG. 1 is a schematic perspective view of a board for gliding on snow according to a first embodiment of the invention;

FIG. 2 shows the same board as in FIG. 1 and is similar to FIG. 1 except that it is partially exploded;

FIGS. 3A, 3B and 3C are schematic plan views, each of which shows a pair of decorative masks applicable to the board in FIG. 1 and forming part of a set of several interchangeable pairs of decorative masks;

DETAILED DESCRIPTION OF THE INVENTION

Figure 4:
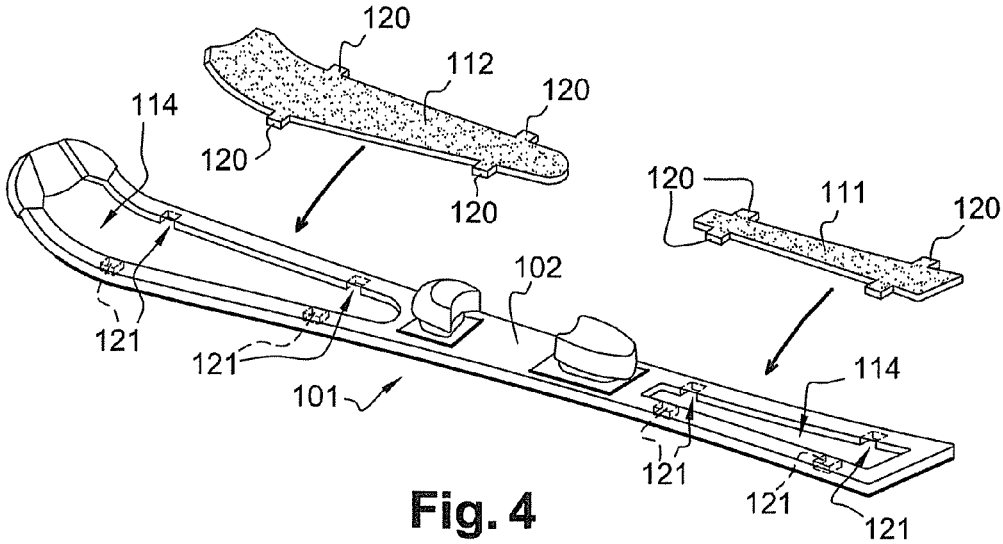
FIG. 4 is a similar view to FIG. 2 and shows a board for gliding on snow in a second embodiment of the invention.

FIG. 1 shows a ski 1 which is according to a first embodiment of the invention and which results from the assembly of a board 2 and a binding 3 for attaching a ski boot, not shown, to this board 2. The board 2 comprises a front spatula 4, of which a protective tip has the numeral 5.

The binding 3 is in two parts which are fixed to the top of the runner portion 6 of the board 2 and which are a back heel 7 and a front stop 8 longitudinally offset from each other.

In the above sentence and in the following discussion, and in the appended claims, the terms "back" and "front" and similar terms, refer to the normal direction of advance of the ski 1 on snow in ordinary use. Similarly, in the following discussion and the appended claims, the terms "bottom" and "top", and similar terms, refer to the position of the ski 1 in normal use, in which a bottom or lower face of the board 2 rests on the snow.

Apart from this bottom, the board 2 comprises a top or upper face 9 and sides 10, which are visible when the ski 1 is used, that is when the board 2 rests on its bottom. Except at the runner portion 6 where a ski boot is positioned in front of it, the top 9 is also visible in normal use. In other words, a portion of this top 9 and the sides 10 form part of the outer surface which is visible in use, and which may also comprise a front portion of the bottom of the spatula 4.

The board 2 carries two removable decorative masks, that is a back mask 11 and a front mask 12, each of which is mounted reversibly on the abovementioned visible surface in a visible hollow recess referenced numeral 14 in FIG. 2. A set of several snap fasteners 15 in two parts 15A and 15B and matchingly joinable to one another maintain each of the masks 11 and 12 and the board 2 assembled together.

For this purpose, the board 2 carries one of the two matching parts of each snap fastener 15, of which the other part 15A is fixed to one of the masks 11 and 12. The bottom parts 15B of the snap fasteners 15 may be integrated with the board 2 when it is hot-molded, while it can also be fixed to this board 2 by simple adhesive. The mounting of the masks 11 and 12 by means of the snap fasteners 15 is reversible in that, after their assembly, these masks 11 and 12 can be removed without damaging the snap fasteners 15, and can therefore be reassembled later by using the same snap fasteners 15 that are still operational.

In the example in FIGS. 1 and 2, each of the masks 11 and 12 is made from a flexible cloth that displays in particular the constitution of a printed cloth and of which the peripheral contour matches the peripheral contour of the hollow recess 14 intended to accommodate it. The snap fasteners 15 for mounting the front mask 12 are placed in succession along the peripheral contour of this mask 12.

The masks 11 and 12 are shown alone in FIG. 3A. They form part of a set of a plurality of interchangeable pairs of removable decorative masks. This set comprises two other pairs, one of which consists of the masks 11*b* and 12*b* shown in FIG. 3B, and the other consisting of the masks 11*c* and 12*c* shown in FIG. 3C.

Each of the masks 11*b* and 11*c* is provided with the same part 15A of the snap fasteners 15 as the mask 11. Similarly, the masks 12*b* and 12*c* carry the same parts 15A of the snap fasteners 15 as the mask 12.

The various interchangeable pairs of the set of masks are distinguished from each other by their aesthetics and their respective styles, in particular by the decors printed thereon. They may also be distinguished from each other by the material constituting their masks. In fact, the flexible layer of which the masks 11, 12, 11*b*, 12*b*, 11*c* and 12*c* are made may in particular comprise a fabric, a nonwoven fabric, leather or lace. Each of these masks may also be deep dyed or not and/or may be provided with one or more accessories such as false buttons and/or a décor that is printed, embroidered or fixed in any other appropriate manner.

The visual appearance of the board 2 may be modified easily. To do this, the masks 11 and 12 positioned on this board 2 are removed, and are replaced by the masks 11*b* and 12*b* or by the masks 11*c* and 12*c*.

It appears from the above that at any time, the aesthetics and the style of the ski 1 can be modified and adapted easily to the passing whim of the user of the ski.

The board 2 provided with the binding 3 is ready for use. It can therefore be used normally equally well if it has one of the pairs of decorative masks of the set mentioned above, and in the opposite case, if it has no decorative mask. In this respect, the masks 11, 12, 11*b*, 12*b*, 11*c* and 12*c* are exclusively decorative in that they do not constitute functional elements of the board 2, even though they are integrated in a technical solution. In short, the masks 11, 12, 11*b*, 12*b*, 11*c* and 12*c* are optional in that the board 2 provided with the binding 3 can be employed without having any of that, or any other decorative mask in their place.

As may be seen in FIG. 2, the tip 5 is joined to the spatula 4 by means of two screws 16, each of which is screwed into a threaded hole 17.

It may be observed that each of the decorative masks 11, 12, 11*b*, 12*b*, 11*c* and 12*c* is flattened and essentially planar once in place, extending mainly along a roughly planar surface that is not curved by more than 45°. Each of these masks is essentially two-dimensional once in place, mainly extending in two main directions such as a width and a length. Each of the decorative masks 11, 12, 11*b*, 12*b*, 11*c* and 12*c* has a thickness perpendicular to these two main directions.

It may also be observed that each of the decorative masks 11, 12, 11*b*, 12*b*, 11*c* and 12*c* comprises a peripheral edge and two main faces connected by this peripheral edge and of which both are essentially turned respectively in a first direction and in a substantially opposite second direction once the mask is in place. These two main phases are more precisely a visible top face in use and a back face, which is hidden in use and faces the board 2.

FIG. 4 shows a ski 101 in a second embodiment of the invention. In the following discussion, it is only described insofar as it is distinguished from the ski 1. Furthermore, a numeral used below to denote part of the ski 101 similar or equivalent to a referenced part of the ski 1 is constructed by adding 100 to the numeral identifying this part in the ski 1.

The masks 111 and 112 are not overly flexible, but consist of elastically flexible slats, each of which is decorative and provided with four lateral nesting tabs 120.

The nesting tabs 120 of each of the decorative masks 111 and 112 are disposed in two pairs opposite one another. Each of them laterally prolongs the mask 111 or the mask 112.

In the edge of each hollow recess 114 four slots 121 terminate, in each of which a nesting tab 120 is intended to be inserted, via an elastic bending of the corresponding mask 111 or 112. Once inserted into the slots 121, the nesting tabs 120 retain the removable masks 111 and 112 in the hollow recesses 114. By means of another elastic bending of the masks 111 and 112, the nesting tabs 120 can be removed from the slots 121 in order to stop the joining of the board 102 and each of the masks 111 and 112. Like the snap fasteners 15, the nesting tabs 120 and the slots 121 form complementary means for a reversible mounting of a decorative mask on a snowboard 102. The nesting tabs 120 may be provided with means for snapping into the slots 121, in a manner similar to what is proposed in the embodiment described below.

Like the decorative masks 11 and 12, the decorative masks 111 and 112 form part of a set of several interchangeable masks, of which the others are not shown for reasons of simplicity.

Figure 5:
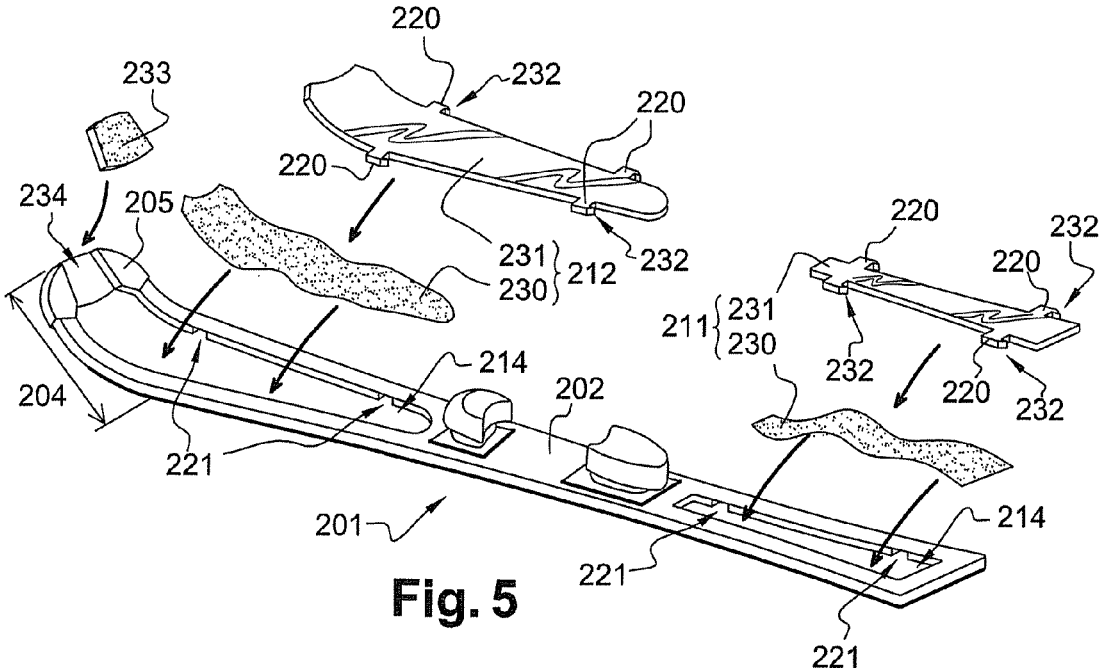
FIG. 5 is also a similar view to FIG. 2 and shows a board for gliding on snow in a third embodiment of the invention.

FIG. 5 shows a ski 201 in a third embodiment of the invention. In the following discussion, it is only described insofar as it is distinguished from the ski 101. Furthermore, a numeral used below to denote part of the ski 201 similar or equivalent to a referenced part of the ski 101 is constructed by adding 100 to the numeral identifying this part in the ski 101.

Each of the masks 211 and 212 is in two parts, one of which is a strip 230 decorated for example by printing. The other part 231 of each of the masks 211 and 212 is a window having the same constitution as the flexible mask 111 (i.e., slat with four lateral nesting tabs) or as the flexible mask 112 of FIG. 4, except that it is made from a transparent material through which one of the decorative strips 230 is visible. The top of each window 231 may be planar or may comprise one or more projecting portions and/or one or more hollow portions.

Furthermore, in the example shown, the nesting tabs 220 of the windows 231 are distinguished from the tabs 120 in that each of them has means for its snapping into a slot 221. These snap-in means may comprise a bevelled pin 232 capable of hooking into a matching slot 221 for the purpose.

Several different pairs of decorated strips 230 are available to the user, who can replace those in place in their recesses 214 of the board 202 by others, by means of the removal followed by the remounting of the transparent window 231.

A third removable decorative mask 233 can be mounted on the board 202, in a hollow recess 234 having a matching shape, which bounds the top of a tip 205 protecting the free end of a front spatula 204 of the board 202. The reversible mounting means of the third mask 233 are of the velcro type. They are sold for example under the trade name Velcro®. These mounting means comprise a strip covered with velvet loops to which hooks carried by another strip can be fastened. One of the two strips is fixed to the bottom of the recess 234, while the other strip covers the underside of the mask 233.

Figure 6:
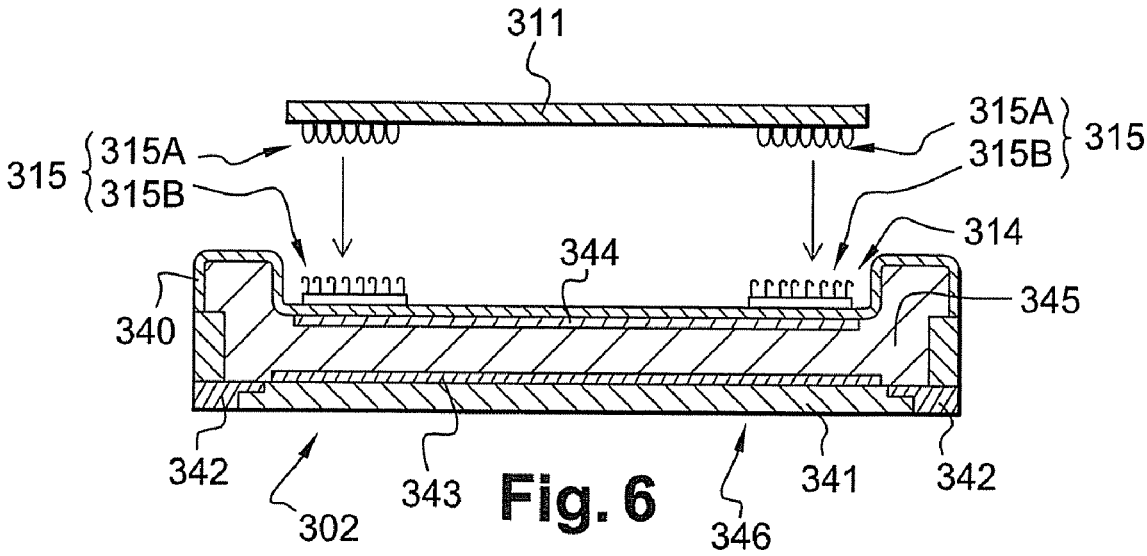
FIG. 6 is a schematic and partially exploded view of a fourth embodiment of a board for gliding on snow according to the invention, in a cross section along a plane similar to plane VI in FIG. 2.

Such reversible mounting means of the velcro type can be seen in FIG. 6, which shows a board 302 constituting a ski in a fourth embodiment of the invention. In the following discussion, only what distinguishes this ski 302 from the ski 2 is described. Furthermore, a reference numeral used below to denote a part of the ski 302 similar or equivalent to a referenced part of the ski 2 and is constructed by adding 300 to the numeral denoting this part in the ski 2.

Each snap fastener 15 is replaced by a velcro mounting device 315, which consists of two parts that are matchingly joinable to each other, that is a velvet part 315A and a hook part 315B.

In the example shown, the mask 311 carries the velvet parts 315A of the mounting devices 315, of which the hook parts 315B are fastened by adhesives or any other appropriate means in the recesses 314, on an upper protective layer 340 constituting the board 302. However, the arrangement may be different. In particular, each velvet part 315A and each hook part 315B can be fastened respectively to the ski 302 and to the removable decorative mask 311. Furthermore, the mounting devices 315 can be elongated in the form of strips and may be two in number, in which case, each of them may run along one longitudinal edge of the hollow recess 314.

Still in FIG. 6, the numeral 341, numeral 342, numeral 343, numeral 344 and numeral 345 respectively denote a sliding base, one having two squares, a bottom reinforcement, a top reinforcement and an expanded foam core, which constitute the board 302. Obviously, this board 302 may have another structure without extending beyond the scope of the invention. The base 341 and the two squares 342 define the bottom or underside 346 of the board 302.

Figure 7:
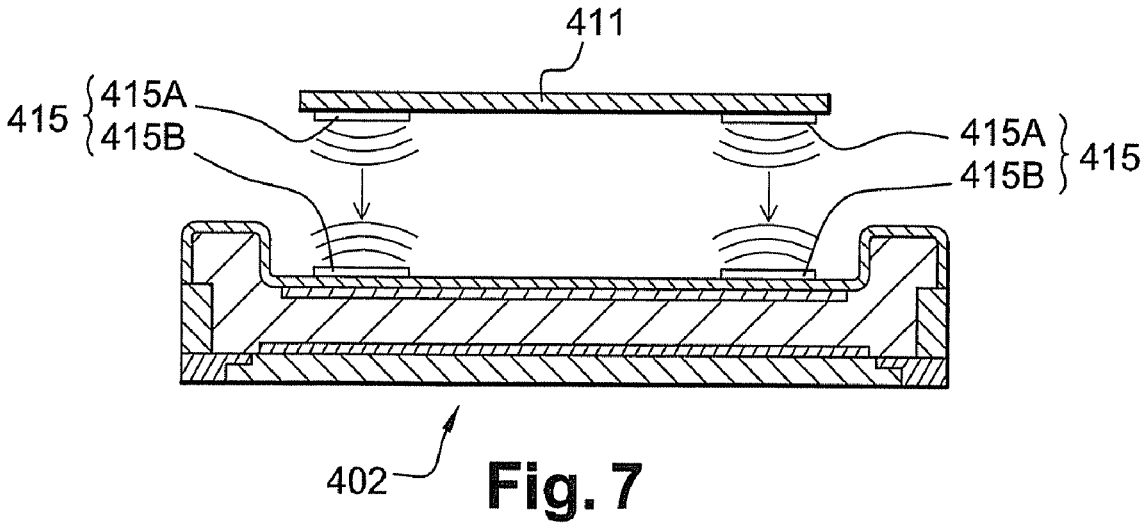
FIG. 7 is a cross section similar to FIG. 6 and shows a board for gliding on snow in a fifth embodiment of the invention.

FIG. 7 shows a ski 402 in a fifth embodiment of the invention. In the following discussion, only what distinguishes it from ski 302 is described. Furthermore, a reference numeral used to denote a part of this ski 402 similar or equivalent to a referenced part of the ski 302 is constructed by adding 100 to the reference identifying this part in the ski 302.

Each of the reversible mounting devices 415 comprises two elements 415A and 415B which are mutually attracted by ferromagnetism. The element 415A is a magnetic strip fixed to the underside of the removable decorative mask 411, but which could also be joined to the board 402. The element 415B is a strip of ferromagnetic metal, which is fixed to the board 402, but which could also be carried by the mask 411.

The invention is not limited to the embodiments described above. In particular, other reversible mounting means than those described here can be provided to join the decorative mask(s) to the board. For example, these mounting means may comprise one or more zip fasteners of a type sold on the market. In this case, part of such a zip fastener is joined to the board, while the other part is mounted on a removable decorative mask.

Furthermore, the means for reversible mounting of a removable decorative mask may comprise a groove for accommodating and retaining an edge of this decorative mask. This groove or rail may be disposed substantially like the slots 121 and 212, that is in the peripheral edge of the hollow recess, while being distinguished from these slots 121 and 221 in that it extends at least along most of the length of this peripheral edge.

Furthermore, it may be provided for the removable decorative mask or at least one of the removable decorative masks to be mounted between the back binding and the front binding of a snowboard, even if each of the decorative masks 11, 12, 11*b*, 12*b*, 11*c*, 12*c*, 111, 112, 211, 212, 311 and 411 of the exemplary embodiments proposed is intended to be installed behind or in front of the runner portion 6. In each case, the or each removable decorative mask is mounted outside each zone for binding a boot, failing which it would not be visible during the use of the board.

Furthermore, the or at least one of the removable decorative masks may not be flattened. In particular, its topside may have one or more hollow portions and/or one or more projecting portions. Such hollow and/or projecting portions may be implicated in the decorative character of the mask. They may even confer the decorative character on the mask, which may not have a printed or painted décor.

Moreover, it may be provided for the or at least one of the removable decorative masks to be mounted on a portion that is not hollowed, for example on a projecting portion such as a bump, and not in a hollow recess.

It may also be provided for at least one portion of the zone where the or one of the removable decorative masks is mounted to extend along one or more of the sides 10. It may also be provided for the decorative mask(s) to be positioned exclusively on the upper side of the board and/or only behind the front spatula, that is, at any location of the surface that is visible in use, except at the front spatula, in particular except at the front tip of the board.

Furthermore, the invention is not limited to ski, even if the embodiments described above concern skis. On the contrary, a snowboard or a cross country ski or even any other type of board can also conform to the invention.

The invention claimed is:

1. A board for gliding on snow, comprising a bottom surface at least partly defined by a base, a top surface and sides which connect the bottom and top surfaces to each other, part of the top surface and the sides defining part of a visible surface of the board in use, a hollow recess penetrating the top surface of the board, and, positioned within the hollow recess, a first part of means for mounting at least one removable decorative mask on said visible surface, wherein the entirety of the removable decorative mask follows the contour of the hollow recess when positioned in the hollow recess.

2. The board for gliding on snow as claimed in claim 1, wherein said first part comprises at least two slots for receiving at least two tabs of said decorative mask.

3. The board for gliding on snow as claimed in claim 2, wherein each of said two slots terminates in one of two opposite sides of the hollow recess.

4. The board for gliding on snow as claimed in claim 1, wherein the hollow recess comprises a peripheral edge in which said first part comprises a groove for accommodating and retaining one edge of said decorative mask, said groove extending along at least most of a length of said peripheral edge.

5. The board for gliding on snow as claimed in claim 1, wherein said means for mounting comprises a plurality of snap fasteners in two matching elements which are connectable to each other, one of which is fixed to the board.

6. The board for gliding on snow as claimed in claim 5, wherein at least a part of said snap fasteners are disposed in succession along a closed contour.

7. The board for gliding on snow as claimed in claim 1, wherein said means for mounting comprises a hook-and-loop means at least partially fixed to the board.

8. The board for gliding on snow as claimed in claim 1, wherein said first part and a second part of said means for mounting comprise two elements which are mutually attracted by ferromagnetism, and wherein one of said first and second parts is fixed to the board.

9. The board for gliding on snow as claimed in claim 1, wherein said removable decorative mask comprises a second part of said means for mounting, and when said removable decorative mask is carried on said board, said first part and said second part of said means for mounting are connected to each other.

10. The board for gliding on snow as claimed in claim 9, wherein said visible surface of the board contains the hollow recess for accommodating said decorative mask, and wherein the hollow recess and said decorative mask have substantially matching peripheral contours.

11. The board for gliding on snow as claimed in claim 9, wherein said decorative mask comprises a cloth provided with said second part of said means for mounting.

12. The board for gliding on snow as claimed in claim 9, wherein said decorative mask comprises a window provided with said second part of said means for mounting, and also a strip which carries a decoration that is visible through said window and which is held between said visible surface of the board and said window.

13. The board for gliding on snow as claimed in claim 9, wherein said decorative mask comprises a slat provided with said second part of said means for mounting.

14. The board for gliding on snow as claimed in claim 13, wherein said first part of said means for mounting comprises at least two slots for inserting tabs for subsequently inserting said decorative mask, and wherein said slat is elastically flexible, said second part of said means for mounting comprising two nesting tabs carried by said slat and which are insertable into said slots via an elastic bending of said slat.

15. The board for gliding on snow as claimed in claim 2, wherein said decorative mask comprises a slat provided with said second part of said means for mounting, and wherein said second part of said means for mounting comprises two tabs carried by said slat, which are insertable into said slots and which are provided with means for nesting in said slots.

16. The board for gliding on snow as claimed in claim 9, wherein said mounted decorative mask is placed on a protective tip of one end of the board.

17. An assembly for the practice of gliding on snow, said assembly comprising the board as claimed in claim 1, and a set of a plurality of interchangeable ones of said decorative mask, each of which comprises a second part of said means for mounting, wherein said first part and said second part of said means for mounting are connected to each other.

* * * * *